US010964296B2

(12) United States Patent
Soga et al.

(10) Patent No.: US 10,964,296 B2
(45) Date of Patent: Mar. 30, 2021

(54) BOARD FOR STRINGED INSTRUMENT, ACOUSTIC STRINGED INSTRUMENT, AND METHOD OF MANUFACTURING BOARD FOR STRINGED INSTRUMENT

(71) Applicant: Yamaha Corporation, Hamamatsu (JP)

(72) Inventors: Kazuki Soga, Hamamatsu (JP); Toshihisa Yamazaki, Jakarta (ID); Hiroshi Nakaya, Hamamatsu (JP); Kenichi Miyazawa, Fukuroi (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 16/502,938

(22) Filed: Jul. 3, 2019

(65) Prior Publication Data

US 2019/0325850 A1 Oct. 24, 2019

Related U.S. Application Data

(63) Continuation of application No. PCT/JP2017/000216, filed on Jan. 6, 2017.

(51) Int. Cl.
*G10D 3/22* (2020.01)
*G10D 1/02* (2006.01)

(52) U.S. Cl.
CPC ..... *G10D 3/22* (2020.02); *G10D 1/02* (2013.01)

(58) Field of Classification Search
CPC ..... G10D 1/005; G10D 1/02; G10D 3/00
See application file for complete search history.

(56) References Cited

U.S. PATENT DOCUMENTS

| | | | | |
|---|---|---|---|---|
| 3,443,466 | A | 5/1969 | Brakewell | |
| 4,353,862 | A * | 10/1982 | Kaman, II | B29C 70/088 264/571 |
| 6,395,845 | B1 | 5/2002 | Weinmann et al. | |
| 9,646,580 | B1 * | 5/2017 | Lee | G10D 1/08 |
| 2006/0174753 | A1 * | 8/2006 | Aisenbrey | G10H 1/32 84/600 |

(Continued)

FOREIGN PATENT DOCUMENTS

| | | | |
|---|---|---|---|
| JP | 52-154225 | U1 | 11/1997 |
| JP | 2000211092 | A | 8/2000 |
| JP | 2002-212304 | A | 7/2002 |

(Continued)

OTHER PUBLICATIONS

International Search Report (PCT/ISA/210) issued in PCT Application No. PCT/JP2017/000216 dated Mar. 21, 2017 with English translation (four (4) pages).

(Continued)

*Primary Examiner* — Kimberly R Lockett
(74) *Attorney, Agent, or Firm* — Crowell & Moring LLP

(57) ABSTRACT

A manufacturing method for a board for a stringed instrument that is used as a top plate or a back plate of an acoustic stringed instrument such as a violin, where the board has a purfling, includes forming, for instance, a groove with a depth that is 20% or more and less than 60% of a thickness of the board for a stringed instrument, filling the groove with a resin in which, for instance, colored particles having a diameter of 3 μm or more and less than 70 μm are dispersed and which has a degree of elongation of 20% or more, removing the resin that has flowed out of the groove, and curing the resin.

7 Claims, 6 Drawing Sheets

(56) References Cited

U.S. PATENT DOCUMENTS

2015/0210431 A1* 7/2015 Togo ..... B32B 15/08
206/524.3

FOREIGN PATENT DOCUMENTS

| | | | |
|---|---|---|---|
| JP | 2010-82874 | A | 4/2010 |
| KR | 10-1655891 | B1 | 9/2016 |

OTHER PUBLICATIONS

Japanese-language Written Opinion (PCT/ISA/237) issued in PCT Application No. PCT/JP2017/000216 dated Mar. 21, 2017 (four (4) pages).
Johnson et al, "The Art of Violin Making", Apr. 1998, Robert Hale Ltd, pp. 120-121, (three (3) pages).
Japanese Office Action issued in counterpart Japanese Application No. 2018-560294 dated Jul. 17, 2020 with machine translation (Ten (10) pages).
Extended European Search Report issued in counterpart European Application No. 17890451.2 dated Jun. 24, 2020 (Ten (10) pages).

* cited by examiner

BOARD FOR STRINGED INSTRUMENT, ACOUSTIC STRINGED INSTRUMENT, AND METHOD OF MANUFACTURING BOARD FOR STRINGED INSTRUMENT

CROSS REFERENCE TO RELATED APPLICATIONS

This application is a Continuation Application of PCT Application No. PCT/JP2017/000216, filed Jan. 6, 2017, the entire contents of which are incorporated herein by reference.

BACKGROUND OF THE INVENTION

Field of the Invention

The present invention relates to a board for a stringed instrument having a purfling, to an acoustic stringed instrument, and to a method of manufacturing a board for a stringed instrument.

Description of Related Art

A violin is constructed by holding a rib between a top plate and a back plate. Additionally, a highly decorative member called a "purfling" is provided at peripheral edges of the top plate and the back plate. Non-Patent Document 1 (Johnson, Chris. (April 1998). The Art of Violin Making. (pp. 120-121): Robert Hale Ltd.) discloses a traditional method of manufacturing a violin. According to this manufacturing method, in a conventional purfling for a violin, grooves having a width of about 2 mm to about 3 mm are engraved on peripheral edges of the top plate and the back plate, respectively. Members obtained by bonding three strips are fitted into the grooves, and then the top plate and the back plate are polished. Each of the members used for the fitting has a structure in which the middle strip among the three strips is sandwiched between the other two strips, which are black. Accordingly, after the members are fitted into the grooves, two black lines are formed on each of the top plate and the back plate. Such a method of manufacturing a violin is a traditional manufacturing method that has been practiced for more than 400 years and continues to this day.

The role of the purfling is to improve durability, in addition to a design effect. Since a straight-grained board is often used for the top plate of the violin, the board may crack along a wood grain when a big impact is applied to the violin. It is possible to absorb the impact by the purfling provided on the peripheral edges of the top plate and the back plate.

In recent years, there has been known a violin in which two black lines are printed on the top plate and the back plate instead of the above-described structure of the purfling. This type of violin has an advantage in that manufacturing cost is reduced, because it does not require skilled craftsmanship to form the purfling.

However, in a method of forming two black lines by printing, once a player has the violin in hand, the player will notice that the purfling is not formed by inlaying. Furthermore, in a case in which the two black lines are formed only by printing, since an internal structure of the top plate and the back plate is in line with the grain, there is a problem in that the top plate or the back plate may crack on impact.

SUMMARY

The present invention has been made in view of such circumstances. An object of the present invention is to provide an acoustic stringed instrument having decorativeness and impact resistance with a simplified manufacturing process, and a method of manufacturing the same.

In order to achieve the aforementioned object, a board for a stringed instrument according to one aspect of the present invention, which is used for a top plate or a back plate of an acoustic stringed instrument, includes a groove formed in the board and a resin filled in the groove.

Furthermore, a method of manufacturing a board for a stringed instrument according to one aspect of the present invention is a method of manufacturing a board for a stringed instrument that is used for a top plate or a back plate of an acoustic stringed instrument, where the board has a purfling, the method including forming a groove in the board, filling the groove with a resin, and curing the resin.

DESCRIPTION OF THE EMBODIMENTS

Hereinafter, an embodiment of the present invention will be described with reference to the drawings.

1. Overall Structure

In the following description, a violin 1 will be described as an example of an acoustic stringed instrument. The violin 1 is merely an example, and the acoustic stringed instrument may be, for example, acoustic bowed stringed instrument such as a cello, a viola, or a contrabass that is similar to a violin.

Figure 1:
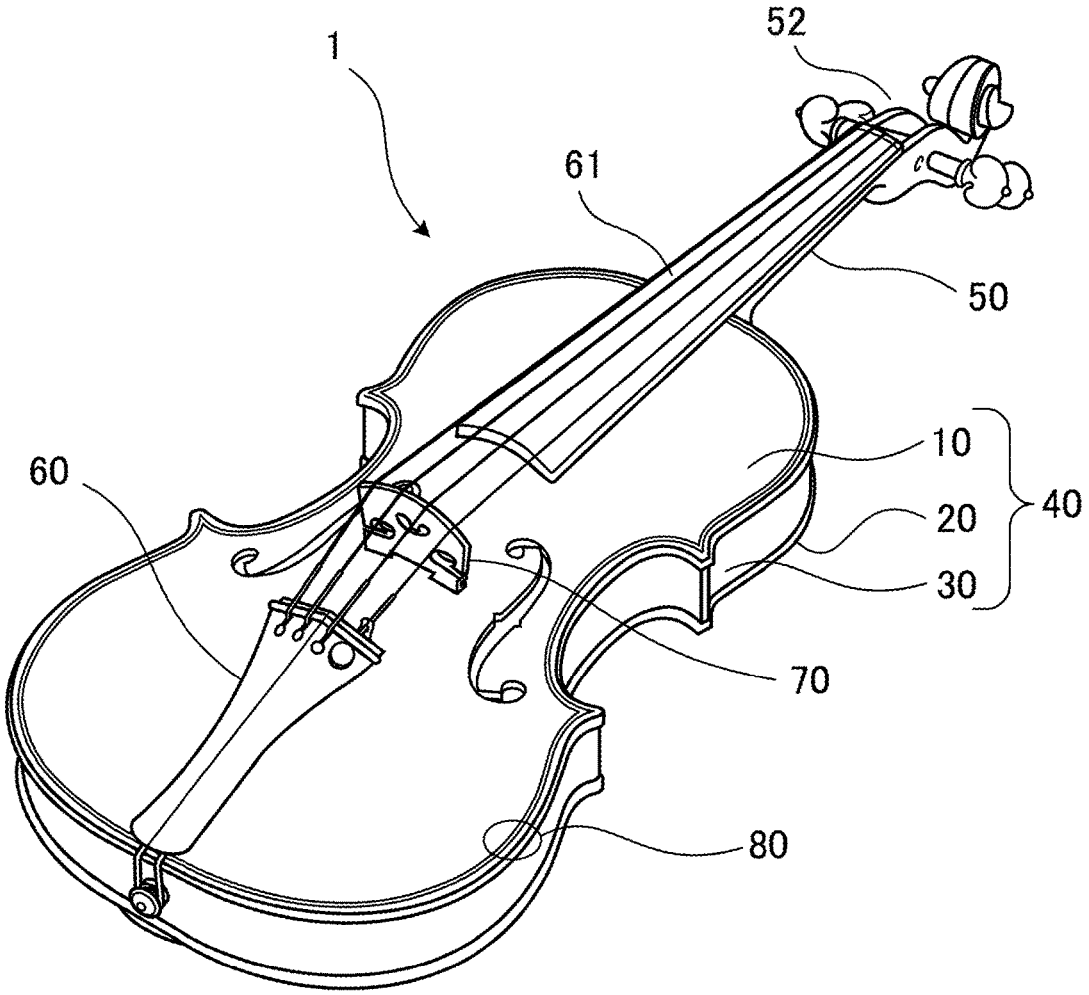
FIG. 1 is an external perspective view of a violin according to an embodiment.

FIG. 1 is an external perspective view of a violin according to an embodiment of the present invention. The violin 1 includes a main body 40 and a neck 50. The main body 40 includes a top plate 10, a back plate 20, and a rib 30 provided between the top plate 10 and the back plate 20.

The top plate 10 is provided with a tailpiece 60 and a bridge 70. One end of each string is fixed to the tailpiece 60. The other end of each string is fixed by means of pegs 52 provided on a neck 50 via a bridge 70. The strings are tightened by winding the pegs 52.

For example, a stacked board is used for the top plate 10. The top plate 10 is formed by bonding a top surface board, a back surface board, and a core board disposed therebetween with an adhesive. A material of a single board for the top surface board, the back surface board, and the core board may be the same or may be different. For example, spruce, maple, pine, cedar, birch, beech, or lauan may be used as the single board. Among them, it is preferable to use spruce, by use of which the top plate is given an excellent functions as a diaphragm. Furthermore, it is preferable that all of the top surface board, the back surface board, and the core board, which constitute the top plate 10, be formed of spruce. The use of spruce for all the materials of the single boards provides a better function as the top plate 10, as a result of which the sound quality of the violin 1 is enhanced (compared to using spruce only in part). Moreover, the top plate 10 according to the embodiment provides a better appearance by using a straight-grained spruce material as the material of the single board forming the top surface board.

Before the top plate 10 is attached to the rib 30, the top plate 10 is formed into the same shape as that after completion of the violin. Alternatively, a top plate 10 that is larger than the completed shape may be prepared, so that the top plate 10 may be fixed to the rib 30, subsequent to which the shape of a peripheral edge of the top plate 10 may be trimmed. A purfling 80 is provided at the peripheral edge of each of the top plate 10 and the back plate 20.

Figure 2:
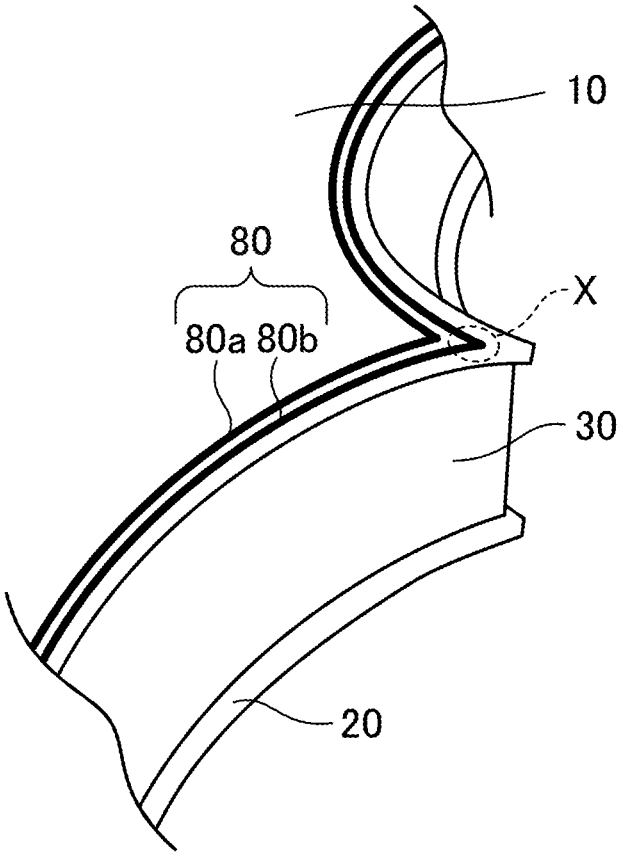
FIG. 2 is a perspective view for explaining purfling

FIG. 2 is an enlarged view showing a part of the purfling 80. As shown in FIG. 2, the purfling 80 has two purfling lines 80*a* and 80*b*. The purfling line 80*b* is formed on the peripheral edge of the top plate 10 at a constant distance from an end of the top plate 10. The purfling line 80*a* is also formed in the same manner.

Figure 3:
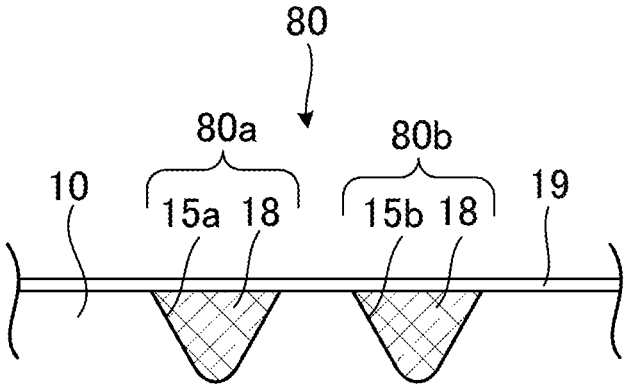
FIG. 3 is a cross-sectional view showing a cross section of the purfling.

FIG. 3 shows a cross-sectional view of the purfling 80. As shown in this drawing, the purfling 80 is configured by filling a groove 15*a* and a groove 15*b* formed in the top plate 10 with resin 18 and providing a protective layer 19 on an upper surface thereof. The groove 15*a* and the groove 15*b* are approximately V-shaped, with the bottom part thereof being rounded. Since the bottom parts are rounded, even when flowability of the resin 18 is relatively low and viscosity thereof is relatively high, it is possible to fill the resin 18 in the groove 15*a* and the groove 15*b* without gaps. It is also possible to reduce occurrence of local stress as compared to sharp V-shapes.

From the viewpoint of facilitating processing, it is preferable that the cross-sectional shapes of the groove 15*a* and the groove 15*b* be the same at any position.

Forming the purfling lines 80*a* and 80*b* by use of the resin 18 has the following advantages.

In a conventional purfling formed by inlaying, the skill of a skilled craftsman is required, for example, in order to align the purfling line 80*a* so that the gap is eliminated and the purfling line 80*a* is continuous in a superposed portion in which the purfling line 80*a* located in a region X in FIG. 2 is bent at an acute angle. On the other hand, the required skill for forming the purfling 80 according to the present embodiment is to fill the groove 15*a* and the groove 15*b* only with the resin 18 which is flowable. Thus, it is possible to fill easily the groove 15*a* and the groove 15*b* with the resin 18 without gaps. Therefore, the purfling 80 is easily manufactured.

Furthermore, in the conventional purfling formed by the inlaying, since a slightly larger member is embedded in the groove, it is necessary to cut out a portion protruding from the groove and then flatten the surface. On the other hand, since the purfling 80 according to the embodiment is formed by filling the groove 15*a* and the groove 15*b* with the resin 18, resin 18 that has flowed out of the groove 15*a* and the groove 15*b* may be wiped off. Therefore, compared to the conventional purfling that requires cutting, the purfling 80 is easily manufactured.

Furthermore, in the conventional purfling formed by the inlaying, due to a difference in contraction rates between the embedding member, and the top plate 10 or the back plate 20, a gap is formed between the groove and the embedding member. Thus cracks may occur on a surface coating. On the other hand, as will be described later, since the purfling 80 according to the embodiment uses the resin 18 having a degree of elongation greater than that of wood. As a result, it is possible to minimize formation of gaps between the resin 18 and each of the groove 15*a* and the groove 15*b*, and thus, prevent cracking of the surface coating.

Furthermore, in a case in which the purfling is formed by printing, a manufacturing process is shortened. However, in the printing of purfling, when an impact is applied to ends of the top plate and the back plate protruding from the rib to the outside, the impact may be transmitted directly to the top plate and the back plate, and cracks may occur along a wood grain.

In contrast, in the purfling 80 according to the embodiment, since the resin 18 serves as a shock absorbing material, the purling 80 absorbs the impact.

Thus, cracking is minimized.

Furthermore, in the case in which the purfling is formed by printing, since the grooves are not formed in the top plate and the back plate, there is a concern that the timbre of a sound would be different from that of inlaying. On the other hand, in the purfling 80 according to the embodiment, since the groove 15*a* and the groove 15*b* are filled with the resin 18, the timbre of the sound is made possible to be closer to that in the purfling 80 formed by the inlaying.

The material of the resin 18 used for the purfling 80 in the top plate 10 and a width and a depth of the groove 15*a* and the groove 15*b* affect acoustic characteristics of the violin 1. Vibration of the top plate 10 is also a major factor because it affects the sound generated by the violin 1. In a normal violin, the peripheral edge is made thinner than a central portion so that the top plate easily vibrates.

In the conventional purfling using the inlaying, wood is embedded in the groove. A fiber direction of the wood is different from a fiber direction of the top plate or the back plate. Therefore, there is a possibility that the purfling using the inlaying may affect the vibration of the violin. However, since all the material of the member to be embedded in the groove and the material of the top plate and the back plate are wood, the influence on the vibration of the violin by adjusting the depth or width of the groove is limited. Accordingly, conventionally, the purfling is not used for adjusting sound quality. In general, in the top plate and the back plate of a violin, the peripheral edges are thinner than the central portions. This is to increase the vibration of the top plate and the back plate. The vibration of the violin is classified into various modes, but the vibration in a direction perpendicular to the top plate and the back plate accounts for a large proportion of the entire vibration of the violin. In the embodiment, since the resin 18 that is softer than wood is filled in the groove 15*a* and the groove 15*b*, the top plate 10 more easily vibrates than the conventional method. That is, it is possible to improve rising of the sound by lowering rigidity of an outer peripheral edge by use of the resin 18. Furthermore, it is possible to control the vibration of the top plate 10 by adjusting the material of the resin 18 or the width and depth of the groove 15*a* and the groove 15*b*. More specifically, as the hardness of the resin 18 is greater and the groove 15*a* and the groove 15*b* each are narrower and shallower, a frequency at which the vibration of the top plate 10 (that is, a resonant frequency of the top plate 10) increases is higher. Conversely, as the hardness of the resin 18 is less and the groove 15*a* and the groove 15*b* each are wider and deeper, the frequency at which the vibration of the top plate 10 increases is lower. In this way, the violin 1 having a distinctive tone can be provided since it is possible to increase the number of factors for adjusting the timbre of the sound of the violin 1 by adopting the resin 18.

2. Resin

Hereinafter, the resin 18 will be described. It is preferable that the resin 18 have a hardness that is less than that of wood. Furthermore, the material of the resin 18 is selected so that the resin 18 is able to respond to changes in temperature or humidity of the top plate 10 and the back plate 20 or changes thereof with time. Therefore, it is preferable to use a soft material that has a large degree of elongation. As a material having such characteristics, for example, a urethane resin or a rubber resin may be adopted. Furthermore, a material that has good adhesion characteristics to wood of the top plate 10 is selected as the resin 18. After the resin 18 is filled in the groove 15*a* and the groove 15*b*, the resin 18 is cured and solidified.

More specifically, the cured resin 18 preferably has a degree of elongation of 20% or more. The degree of elongation is determined by a length up to breakage when the resin 18 having a linear shape is pulled. When an original length is L1 and a length at the time of breakage is L2, the degree of elongation is obtained by (L2−L1)/L1.

When the resin satisfies this condition, changes in the width are followed even when the widths of the groove 15*a* and the groove 15*b* change due to environmental changes. It is anticipated that the widths of the groove 15*a* and the groove 15*b* will be a maximum of 1.2 times the original widths, depending on environmental changes. Even in such a case, when the degree of elongation is 20% or more, no gap is formed in the groove 15*a* and the groove 15*b*. Thus, it is possible to minimize cracking due to generation of a gap and also to minimize the cracking of the purfling lines 80*a* and 80*b*.

Furthermore, the resin 18 may be colored using a dye or a pigment. However, when a coloring agent is used, the coloring agent penetrates into the inside from the groove 15*a* and the groove 15*b*. The top plate 10 and the back plate 20 are formed of wood. The wood has many gaps in its cross section. When the resin 18 penetrates into the gaps, spreading occurs. As a result, the purfling lines 80*a* and 80*b* appear blurry. Therefore, it is preferable that a transparent or translucent resin 18 contain a filler. Such a filler may be in the form of small pieces or beads. In the case of beads, it is preferable that a diameter be 3 μm or more to less than 70 μm and that they be colored. Black beads may be used as the filler. The reason for setting the diameter of the beads to 3 μm or more to less than 70 μm is as follows. In a case in which the beads have such a size, the beads are larger than gaps of wood tissue and thus the penetration of the filler is suppressed. Furthermore, the resin 18 preferably has a large amount of filler and a small amount of a volatile component. In this case, a change in volume after curing is small, and thus, it is possible to finish smoothly.

3. Method of Manufacturing Purfling

FIGS. 4A to 4D are diagrams for explaining a manufacturing process for manufacturing the purfling 80. Although the following description explains the manufacturing process of forming the purfling 80 on the top plate 10, the purfling 80 is also formed on the back plate 20 by the same process.

Figure 4A:
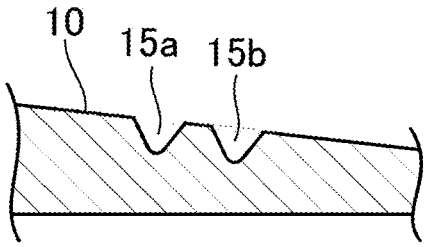
FIG. 4A is a process diagram showing a production process of the purfling.

In a first process, as shown in FIG. 4A, two grooves 15*a* and 15*b* are formed in the top plate 10 (the board). For example, the groove 15*a* and the groove 15*b* are formed by laser processing. It is possible to perform the process with high accuracy using the laser processing even when the width of the purfling lines 80*a* and 80*b* is 1 mm or less. The formation of the groove 15*a* and the groove 15*b* is not limited to the laser processing. The groove 15*a* and the groove 15*b* may be performed by cutting using a mill. Alternatively, a worker may perform the groove 15*a* and the groove 15*b* using a chisel.

Here, the depths of the groove 15*a* and the groove 15*b* are preferably 20% or more and less than 60% of a thickness of the board. The reason for setting the depths in such a range is as follows. In a case in which the depths of the groove 15*a* and the groove 15*b* are too shallow, the resin 18 cannot be sufficiently filled and impact absorption and suppression of the cracking may not be sufficiently achieved. On the other hand, in a case in which the depths of the groove 15*a* and the groove 15*b* are too deep, strength is compromised and the cracking occurs easily.

Figure 4B:
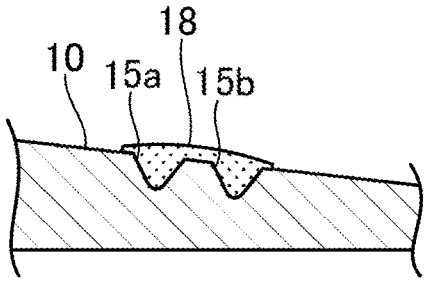
FIG. 4B is a process diagram showing the production process of the purfling.

In a second process, as shown in FIG. 4B, the groove 15*a* and the groove 15*b* are filled with the resin 18 in which the filler is dispersed. Specifically, a worker may perform the filling by rubbing the resin 18 into the groove 15*a* and the groove 15*b* using a finger. The resin 18 may of course also be filled by using a manufacturing device.

Figure 4C:
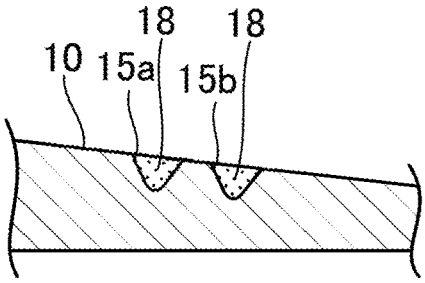
FIG. 4C is a process diagram showing the production process of the purfling.

In a third process, as shown in FIG. 4C, the resin 18 that has flowed out of the groove 15*a* and the groove 15*b* is removed. Specifically, a person may wipe it off with a cloth, or a manufacturing device may remove any resin 18 that overflowed. Thus, the surface of the top plate 10 becomes flat, and the groove 15*a* and the groove 15*b* are filled with the resin 18.

Figure 4D:
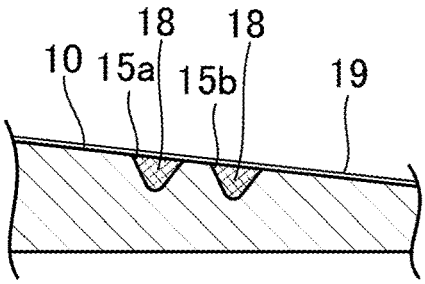
FIG. 4D is a process diagram showing the production process of the purfling.

In a fourth process, as shown in FIG. 4D, the resin 18 filled in the groove 15*a* and the groove 15*b* is cured. A curing method for the resin 18 is determined according to the type of resin 18. For example, the resin 18 may be cured by drying, heating, irradiation of ultraviolet light or the like. Thereafter, the surface of the top plate 10 is coated with a varnish or the like, and thus, a protective layer 19 is formed. Thus, the purfling 80 is completed.

The protective layer 19 has a function of protecting the violin 1 from dryness and humidity.

In the violin 1, the back plate 20 and the rib 30 are bonded with an adhesive, such as a glue. Then, the rib 30 and the top plate 10 are bonded with an adhesive, such as a glue, and the main body 40 is formed. Thereafter, the neck 50 is attached to the main body 40, and the surface thereof is coated with a varnish. Next, a fingerboard is bonded, and a sound post (not shown) is set. After that, the bridge 70 is provided and strings are drawn.

4. Shape of Groove

In the above-described embodiment, although the shape shown in FIG. 3 is exemplified as the cross-sectional shape of the groove 15*a* and the groove 15*b*, there are various aspects in the cross-sectional shape. Hereinafter, the cross-sectional shape of the groove 15*a* will be described. In addition, the cross-sectional shape of the groove 15*b* is also the same. However, the cross-sectional shapes of the groove 15*a* and the groove 15*b* may be different from each other.

Figure 5A:
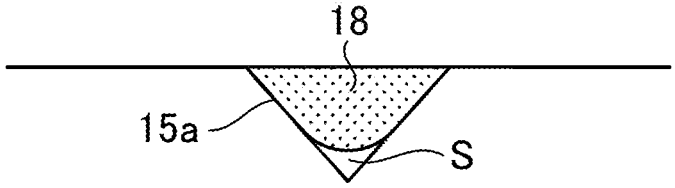
FIG. 5A is a cross-sectional view showing another example of a groove.

The cross-sectional shape of the groove 15*a* shown in FIG. 5A is a V shape. In this example, the resin 18 is not completely filled in the groove 15*a*. Even when a volume of the resin 18 increases due to environmental changes, the increased amount is absorbed in a space S.

Figure 5B:
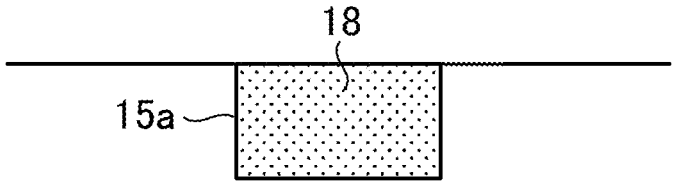
FIG. 5B is a cross-sectional view showing another example of the groove.
Figure 5C:
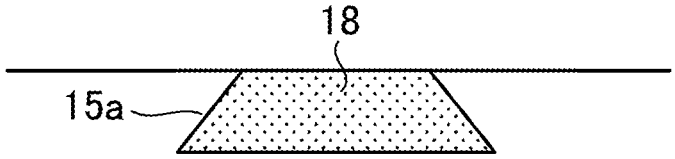
FIG. 5C is a cross-sectional view showing another example of the groove.

The cross-sectional shape of the groove 15*a* shown in FIG. 5B is a rectangular shape. In this case, the purfling 80 may be easily manufactured by a well-known method. The cross-sectional shape of the groove 15*a* shown in FIG. 5C is a trapezoidal shape, and the width at the bottom is greater than the width at the top. A filling amount of the resin 18 is increased even when the width of the purfling line 80*a*, seen from the outside, is the same as that in FIG. 5B, by adopting this cross-sectional shape. Accordingly, it is possible to minimize damping of the vibration of the top plate 10.

Figure 5D:
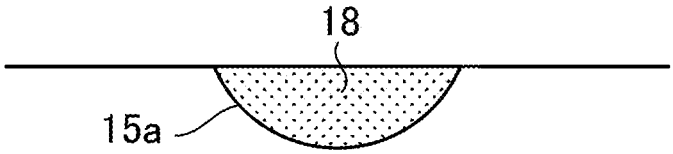
FIG. 5D is a cross-sectional view showing another example of the groove.

The cross-sectional shape of the groove 15*a* shown in FIG. 5D is an arc shape. The groove 15*a* having this cross-sectional shape is easy to manufacture.

Figure 5E:
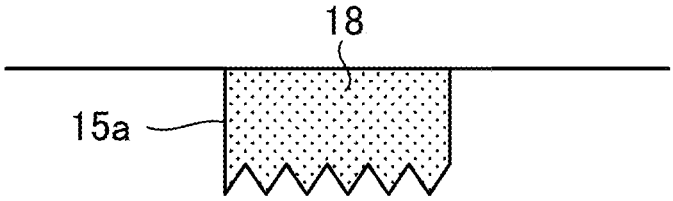
FIG. 5E is a cross-sectional view showing another example of the groove.

The cross-sectional shape of the groove 15*a* shown in FIG. 5E is a shape having unevenness on a bottom surface thereof. For this reason, a contact area between the top plate 10 and the resin 18 becomes large. Therefore, the resin 18 is firmly fixed to the top plate 10. As a result, it is possible to form purfling line 80*a* that is difficult to peel off.

Figure 5F:
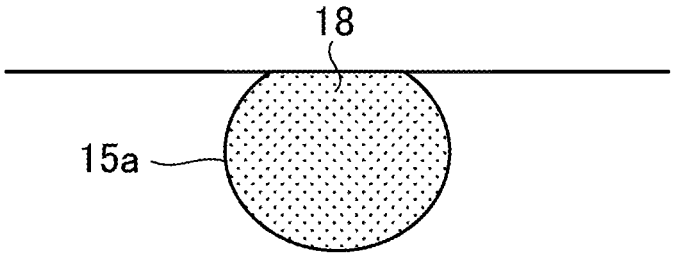
FIG. 5F is a cross-sectional view showing another example of the groove.

The cross-sectional shape of the groove 15*a* shown in FIG. 5F is a round shape. In this cross-sectional shape, similarly to the trapezoidal shape of FIG. 5C, the filling amount of the resin 18 is large even when the width of the purfling line 80*a*, seen from the outside, is the same as that of FIG. 5B. Increasing the amount of the resin 18 minimizes damping of the vibration of the top plate 10.

5. Modified Examples

The present invention is not limited to the various embodiments described above, and, for example, various applications and modifications described below are possible. Furthermore, in the aspects of applications and modifications described below, one or more freely selected ones may be appropriately combined.

(1) Although the violin 1 is exemplified in the above-described embodiment, the present invention is not limited thereto and may be applied to any musical instrument as long as the instrument would need provision of the purfling 80. For example, it may be an acoustic stringed instrument such as a jazz guitar or a classical guitar having an arch top. In the jazz guitar, the purfling may be provided on the peripheral edge of the top plate. Thus, the present invention may be applied to the jazz guitar. Also, in the classical guitar, the purfling may be provided on the peripheral edge of the top plate or around a sound hole.

(2) In the above-described embodiment, an example is described in which the resin 18 is transparent or translucent and the filler is colored, but the present invention is not limited thereto. The resin 18 may contain a black or dark brown pigment. It is preferable that the color of the purfling lines 80*a* and 80*b* be in contrast to the color of the top plate 10 or the back plate 20 such that a user recognizes the two lines. From the viewpoint of making the user perceive two lines, the color of a strip between the purfling lines 80*a* and 80*b* may be different from the color of the top plate 10.

(3) In filling the groove 15*a* and the groove 15*b* with the resin 18 in the above-described embodiment, portions other than the groove 15*a* and the groove 15*b* may be masked beforehand, and the groove 15*a* and the groove 15*b* may be filled with the resin 18. In this case, an advantage is obtained in that the surface of the top plate 10 is not degraded by the excess resin 18.

Furthermore, when the flowability of the resin 18 is high, the resin 18 may be applied or sprayed to fill the groove 15*a* and the groove 15*b*. Furthermore, when the resin 18 before curing is a liquid, the resin 18 may be poured into the groove 15*a* and the groove 15*b* and then cured in a state in which a level is maintained.

(4) In the above-described embodiment, although the groove 15*a* and the groove 15*b* have the same cross-sectional shape at any position, the present invention is not limited thereto. The cross-sectional shapes may be different depending on position. Also, cross-sectional areas of the groove 15*a* and the groove 15*b* may be changed depending on a position. Furthermore, at least one of the width or depth of the groove 15*a* and the groove 15*b* may be changed depending on position. Changing the shapes of the groove 15*a* and the groove 15*b* in this way enables vibration to be damped at a predetermined frequency or vibration to be increased at a predetermined frequency. As a result, the acoustic characteristics of the violin 1 can be adjusted.

However, it is preferable that line width of the purfling lines 80*a* and 80*b* be aesthetically constant. Therefore, the depths of the groove 15*a* and the groove 15*b* may be set depending on a position while making the line width be constant such that the uniform line is recognized from the outside.

(5) In the above-described embodiment, after the resin 18 is filled in the groove 15*a* and the groove 15*b*, the resin 18 that has flowed out of the groove 15*a* and the groove 15*b* is removed, and then the resin 18 is cured. However, the present invention is not limited thereto. The resin 18 may be filled in the groove 15*a* and the groove 15*b*, subsequent to which the resin 18 may be cured, and then excess resin 18 may be removed by polishing using sandpaper or the like.

(6) In the above-described embodiment, although the top plate 10 and the back plate 20 are formed of a stacked material, the present invention is not limited thereto. The top plate 10 and the back plate 20 may be configured using any material. For example, at least one of the top plate 10 or the back plate 20 may be configured using a single board.

Also, regardless of the content of cellulose and wood, a fiber board or a high pressure laminate body may be used.

Furthermore, non-wood materials may be used for the top plate 10 and the back plate 20. For example, carbon fibers or glass fibers may be used.

(7) In the above-described embodiment, although the grooves 15*a* and the grooves 15*b* are formed by cutting out, the present invention is not limited thereto. For example, the grooves 15*a* and the grooves 15*b* may be formed by pressing. Alternatively, when the top plate 10 and the back plate 20 are formed of a fiber board or a stacked material, the top plate 10 and the back plate 20 may be formed using a mold in which the groove 15*a* and the groove 15*b* are formed.

Figure 6:
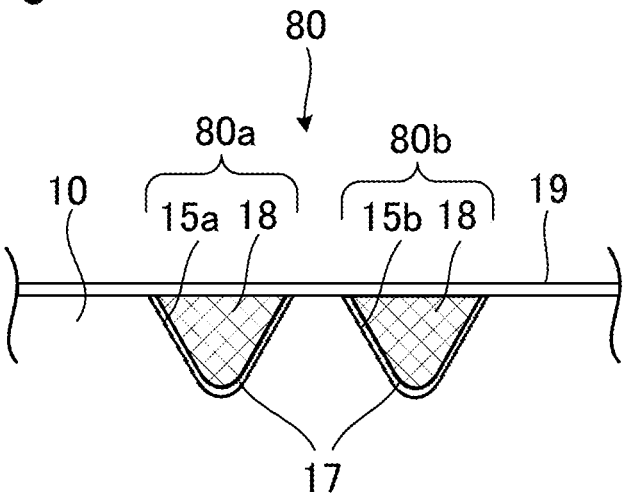
FIG. 6 is a cross-sectional view showing a structure of the purfling according to a modified example.

(8) In the above-described embodiment, although the resin 18 is in direct contact with the groove 15*a* and the groove 15*b*, the present invention is not limited thereto. There may be provided a layer that covers at least the groove 15*a* and the groove 15*b*. Such a layer is a functional layer that is capable of promoting adhesion or minimizing the penetration of the resin 18 into wood. FIG. 6 shows a cross-sectional view of the purfling 80 according to a modified example. As shown in this drawing, there is formed a functional layer 17 that covers the groove 15*a* and the groove 15*b*. In a case in which the functional layer 17 has a function of minimizing the penetration of the resin 18 into wood, even when the resin 18 colored with a dye or a pigment is used, no spreading occurs in the purfling lines 80*a* and 80*b*. The functional layer 17 is preferably transparent. This is because as long as functional layer 17 is transparent, the appearance will not be impaired even if it penetrates into the top plate 10 through the groove 15*a* and the groove 15*b*.

Additionally, even if the functional layer 17 penetrates through gaps in wood tissue, the resin 18 no longer penetrates after curing of the functional layer 17. Thus, sharp purfling lines 80*a* and 80*b* are formed.

Figure 7:
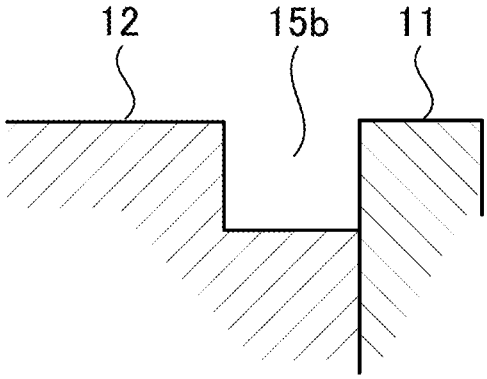
FIG. 7 is a cross-sectional view showing a structure of the groove according to a modified example.

(9) In the above-described embodiment, although the groove 15*b* is formed in the top plate 10 and the back plate 20 by the laser processing, the present invention is not limited thereto. The groove 15*b* which is closer to an end of the top plate 10 than that of the groove 15*a* may be formed by another method. For example, the groove 15*b* may be formed by combining a plurality of members. Specifically, an end 12 of the top plate 10 is formed into a shape shown in FIG. 7. Then, for example, as shown in FIG. 7, a separately prepared member 11 and the end 12 of the top plate 10 may be bonded to each other, to form the groove 15*b*. The same applies to the back plate 20. According to this modified example, cutting may be unnecessary.

The following invention will be derived from the above-described embodiment and modified examples. First, one aspect of a board for a stringed instrument is a board for a stringed instrument used for a top plate or a back plate of an acoustic stringed instrument, where the board for the stringed instrument has a purfling, the purfling includes a groove formed in the board and a resin filled in the groove. In this board for a stringed instrument, it is possible to form the purfling with the groove and the resin. Therefore, it can be manufactured easily as compared with the embedded-type purfling.

Next, one aspect of an acoustic stringed instrument includes a top plate, a back plate, and a rib provided between the top plate and the back plate, and is used as at least one of the top plate or the back plate is the above-described board for the stringed instrument. According to one aspect of the acoustic stringed instrument, it is possible to enhance the impact resistance because the resin absorbs the impact. Furthermore, it is possible to adjust the vibration of the top plate by adjusting the depth and width of the groove and selecting an appropriate type of the material for the resin. Accordingly, it is possible to adjust acoustic characteristics of the acoustic stringed instrument.

In one aspect of the above-described acoustic stringed instrument, the resin preferably has a degree of elongation of 20% or more. If the resin satisfies this condition, it is possible to follow changes in the width even when the width of the groove changes due to environmental changes. As a result, it is possible to minimize the generation of gaps between the resin and the groove and to minimize paint cracking due to the generation of gaps.

In one aspect of the above-described acoustic stringed instrument, a depth of the groove is preferably 20% or more and less than 60% of the thickness of the board for the stringed instrument. In a case in which the groove is too shallow, the resin cannot be sufficiently filled in. Thus, the impact absorption and the suppression of cracking may not be sufficiently achieved. On the other hand, in a case in which the groove is too deep, the strength of the board for the stringed instrument is undermined, and the board is subject to cracking. Such a disadvantage does not occur if the depth of the groove is 20% or more and less than 60% of the thickness of the board for the stringed instrument. In other words, it is possible to adjust the characteristics of the sound of the acoustic stringed instrument by adjusting the depth of the groove within a range of 20% or more and less than 60% of the thickness of the board for a stringed instrument.

In one aspect of the above-described acoustic stringed instrument, it is preferable that the resin includes colored particles having a diameter of 3 μm or more and less than 70 μm and the colored particles be dispersed in the resin. Since the particles having such a size are often larger than the gaps of the wood tissue, it is possible to avoid the filler penetrating through the surface of the groove to the inside.

A manufacturing method is also derivable. Such an invention is a method for manufacturing a board for a stringed instrument that is used for a top plate or a back plate of an acoustic stringed instrument, where the board has a purfling; the method includes a process of forming a groove in a board, a process of filling the groove with a resin, and a process of curing the resin. According to this invention, since it is not necessary to fit the stacked material into the groove by inlaying, it is possible even for a person who is not highly skilled to manufacture the board for a stringed instrument having the purfling.

Furthermore, the above-described manufacturing method includes removing the resin that has flowed out of the groove after the filling of the groove with the resin and before the curing of the resin. Removal of the resin may be performed before or after curing of the resin.

Furthermore, the above-described manufacturing method preferably includes providing a layer that covers a surface of the groove after the forming the groove in the board and before filling the groove with the resin. According to this aspect, it is possible to minimize penetration of the resin through a rib of the groove into the inside.

DESCRIPTION OF REFERENCE SIGNS

10: Top plate
15*a*, 15*b*: Groove
17: Functional layer
18: Resin
19: Protective layer
20: Back plate
30: Rib
40: Main body
50: Neck

What is claimed is:

1. A board for a stringed instrument, used for a top plate or a back plate of an acoustic stringed instrument, where the board for the stringed instrument has a purfling, the purfling comprising:

a groove formed in the board; and a resin filled in the groove, wherein a depth of the groove is 20% or more and less than 60% of a thickness of the board for the stringed instrument.

2. The board for the stringed instrument according to claim 1, wherein the resin has a degree of elongation of 20% or more.

3. The board for the stringed instrument according to claim 1, wherein the resin is a urethane resin or a rubber resin.

4. A board for a stringed instrument, used for a top plate or a back plate of an acoustic stringed instrument, where the board for the stringed instrument has a purfling, the purfling comprising:

a groove formed in the board; and a resin filled in the groove, wherein the resin includes colored particles having a diameter of 3 μm or more and less than 70 μm, and wherein the colored particles are dispersed in the resin.

5. A method of manufacturing a board for a stringed instrument that is used for a top plate or a back plate of an acoustic stringed instrument, where the board for the stringed instrument has a purfling, the method comprising:

forming a groove in the board;

filling the groove with a resin;

curing the resin; and providing a layer that covers a surface of the groove after the forming of the groove in the board and before the filling of the groove with the resin.

6. The method according to claim 5, wherein the resin has a degree of elongation of 20% or more.

7. The method according to claim 5, further comprising removing the resin that has flowed out of the groove after the filling of the groove with the resin and before the curing of the resin.

* * * * *